United States Patent [19]

Schonberger

[11] Patent Number: 4,519,515

[45] Date of Patent: May 28, 1985

[54] DISC FOR INDICATOR FOR TAMPER-EVIDENT LID

[76] Inventor: Milton Schonberger, One Century Tower, Fort Lee, N.J. 07024

[21] Appl. No.: 558,807

[22] Filed: Dec. 7, 1983

Related U.S. Application Data

[63] Continuation-in-part of Ser. No. 549,975, Nov. 9, 1983, , which is a continuation-in-part of Ser. No. 484,636, Apr. 13, 1983, Pat. No. 4,480,760, which is a continuation-in-part of Ser. No. 451,794, Dec. 21, 1982, abandoned.

[51] Int. Cl.[3] ..... B65D 55/02

[52] U.S. Cl. ..... 215/230

[58] Field of Search ..... 215/230, 203, 365, 366; 206/807; 220/359

[56] References Cited

U.S. PATENT DOCUMENTS

| | | | |
|---|---|---|---|
| 2,131,774 | 10/1938 | Waring | 215/365 X |
| 2,131,775 | 10/1938 | Waring | 215/365 X |
| 2,939,597 | 6/1960 | Greene | 215/230 |
| 3,896,965 | 7/1975 | Cornell | 220/359 |
| 3,923,198 | 12/1975 | Brochman | 220/359 |
| 4,197,947 | 4/1980 | Zaidi | 206/807 |
| 4,266,687 | 5/1981 | Cummings | 215/232 X |
| 4,424,911 | 1/1984 | Resnick | 215/365 |
| 4,446,979 | 5/1984 | Gach et al. | 215/203 |
| 4,475,661 | 10/1984 | Griffin | 215/366 |
| 4,480,760 | 11/1984 | Schonberger | 215/230 |

*Primary Examiner*—Steven M. Pollard

*Attorney, Agent, or Firm*—Ostrolenk, Faber, Gerb & Soffen

[57] ABSTRACT

An indicator arrangement for a tamper-evident container lid. A disc seated atop the open neck of the container is coated at its top surface with microcapsules filled with a dye which changes color upon exposure to air, when the capsules are ruptured. The underside of the lid over the container carries an abrasive which ruptures the capsules when the lid is rotated with respect to the disc. The lid permits viewing of the indication through the lid. The disc is of an extruded, expanded polystyrene foam which resiliently deforms to press the indicator capsules against the abrasive in the lid and which compensates for manufacturing tolerances in the container, lid and disc. The annular periphery of the disc is permanently compressed to define a stiffer ridigidying support for the disc, which prevents the disc from deforming under the pressure applied thereto by the underside of the lid.

18 Claims, 6 Drawing Figures

FIG. 1.
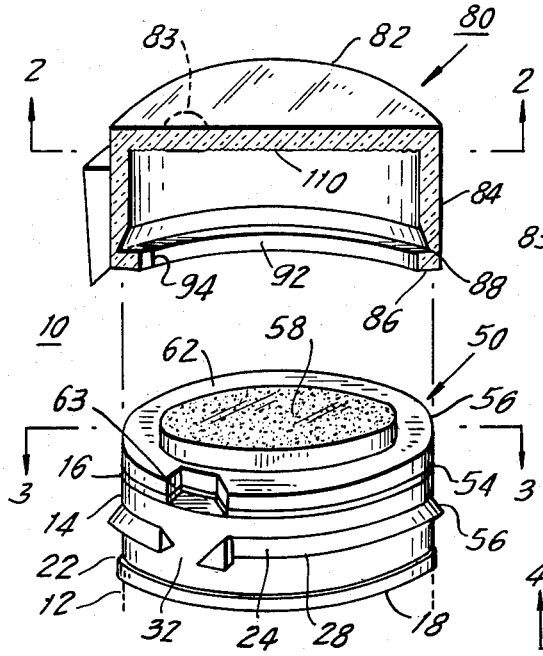
FIG. 2.
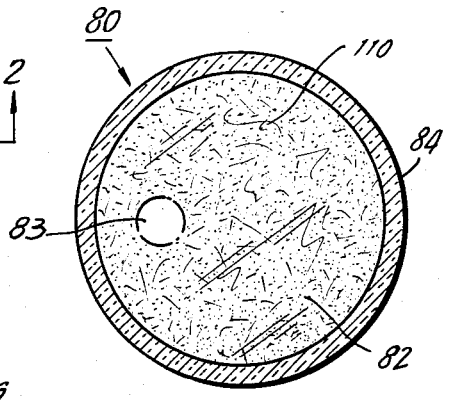
FIG. 3.
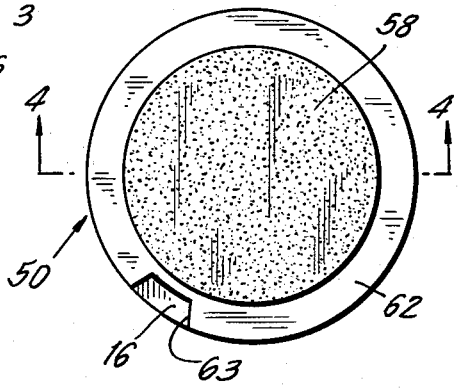
FIG. 6.
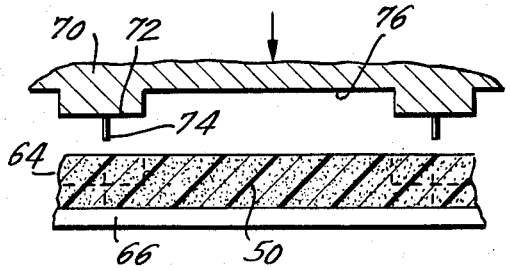
FIG. 4.
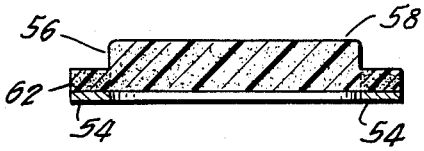
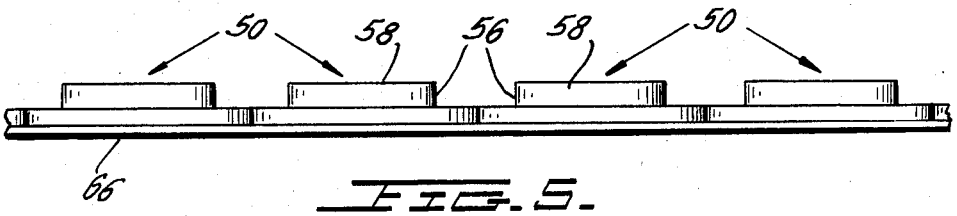
FIG. 5.

DISC FOR INDICATOR FOR TAMPER-EVIDENT LID

CROSS-REFERENCE TO RELATED APPLICATIONS

This is a continuation-in-part of U.S. Application Ser. No. 549,975, filed Nov. 9, 1983, which is a continuation-in-part of U.S. Application Ser. No. 484,636, filed Apr. 13, 1983, now patent No. 4,480,760, which is a continuation-in-part of U.S. Application Ser. No. 451,794, filed Dec. 21, 1982, now abandoned.

BACKGROUND OF THE INVENTION

This invention relates to a tamper-evident lid for a container having a lid which is removed by rotating it. This is an improvement upon the tamper-evident lid contained in the inventor's U.S. Application Ser. No. 549,975, filed Nov. 9, 1983.

In the prior application, there is disclosure of a tamper-evident lid comprising a disc which covers the open neck of a container, and the disc carries an indicator on its top. The indicator is, for example, in the form of microcapsules of a color-changeable dye or ink supported on a paper layer and the ink is a conventional leuco dye. Such dye is available from Appleton Papers, Inc. of Appleton, Wisconsin. Also, NCR Paper SC White 190, also made by Appleton Papers, Inc., is a paper coated with such a leuco dye. The indicator in its microcapsules is activated by rubbing it. In the lid of the container, there are means for rubbing the indicator for activating it upon rotation of the lid on the container. A person can ascertain from the presence or absence of a visible indication at the indicator on the disc whether the lid had been rotated, i.e. whether an effort had been made to remove the container lid.

Rubbing the indicator requires adequate and sufficiently distributed pressure between the rubbing means in the lid and the indicator supported on the disc at the neck of the container. Where the indicator comprises a sheet of microcapsules filled with an ink or leuco dye, which becomes visible upon exposure to air, it is necessary that a large quantity of capsules near each other be broken before the indication will become dark enough. Therefore, the rubbing means must rupture sufficient microcapsules.

The disc at the top of the container may yield and deflect under the pressure exerted by the lid and it may bow downwardly at its center. The rubbing means in the lid may not uniformly rub the indicator so that the entire indicator layer of capsules may not be uniformly activated. Also, due to manufacturing tolerances in the container, disc and/or lid, the rubbing means in the lid may be tilted slightly with respect to the indicator layer on the disc so that there is not uniform activation of the indicator across the whole indicator layer.

The conventional disc installed at the neck of the container for sealing closed the opening in the neck is usually a piece of paper, perhaps wax coated, a piece of plastic, metal foil, etc. In the invention of U.S. Application Ser. No. 549,975, a thin, multi-layer disc is used. It has a base or substrate of a thin, somewhat rigid layer, e.g. of polyethylene plastic, for support of the layers above it for ensuring secure engagement between the indicator and the rubbing means. A thin layer of resilient material, e.g. foam material, is disposed over the substrate. The resilient foam material biases the next described indicator layer toward the rubbing means.

Above the foam material is the indicator, contained in a thin layer of microcapsules disposed on a paper substrate, for example. The microcapsules contain a dye or ink which darkens when exposed to air, which exposure occurs through rupturing of the capsules. The height of the multi-layer disc is selected to cooperate with the height of the rubbing means at the lid so that the indicator and the rubbing means firmly engage. Beneath the base or substrate is a ring of adhesive by which the disc is non-rotatably adhered to the neck of the container. But, the adhesive permits the disc to be removed from the container once the lid of the container has been removed. Means may be provided for rigidifying the disc for further ensuring secure engagement between the indicator layer and the rubbing means in the lid.

The lid of the container is of the type which is rotated for removal. It may be a screw type. Alternatively, it may be the type with a flange which engages beneath a collar on the container neck and the lid flange includes a radially inwardly projecting tab or key which locks beneath the collar of the container until the lid has been rotated to a position where the key on the lid is aligned with a keyway in the collar of the bottle. Upon this alignment, the lid may be lifted free of the container.

Rubbing means are carried at the underside of the lid. The lid is shaped so that the rubbing means cooperate with the indicator at the top of the disc to rub the indicator and break the microcapsules. The rubbing means are preferably in the form of an abrasive material which is either molded directly into the underside of the lid, e.g. when the lid is molded, or is provided on the underside of a second disc which is supported beneath the top of the lid. Where a disc is provided under the lid, the abrasive may be supported on a resilient layer, such as a foam backing, which would also bias the abrasive down toward the indicator beneath it, for assuring secure engagement between them.

The user must be able to view the indicator to see whether it has been activated. The lid may be of light transmitting, transparent or translucent material, so that the indicator may be visible through the lid. The visibility problem is resolved by providing an interruption in the abrasive material, through which a clear view of the indicator beneath is made possible.

SUMMARY OF THE INVENTION

This invention is an improvement upon the indicator for a tamper-evident lid that is disclosed in the aforesaid U.S. Application Ser. No. 549,975, filed Nov. 22, 1983. The preceding description of a tamper-evident lid is an abridged version of the description in the aforesaid application. The present invention is an improvement over that prior disclosure, and particularly is an improvement over the indicator disc described there.

In place of the multilayer disc described above, the present invention contemplates providing a disc which is effectively only a single layer comprised of extruded, expanded polystyrene foam material. The thickness of the foam material is related to the diameter of the disc, in that the disc should be thick enough to prevent the disc against bowing when the lid is applied to the container with the disc in place. The disc is thick enough that it needs no substrate or backing to support it, e.g. a disc of about 1 inch diameter, may be 0.080 inch thick, and the foam may have a density of 7–8 lbs. per cubic foot. Such foam material is conventional, and can be obtained from a company named Valcour Papers Corporation, for example. If the container involved is one for holding pills, tablets, capsules, medication, etc., or other small items to be dispensed, the opening into the container neck would be of relatively small diameter, so that this foam material disc would be rigid enough to maintain secure engagement with the rubbing means for assuring activation of the indicator atop the disc. The foam material is selected because it is somewhat yieldable, whereby manufacturing tolerances with respect to the neck of the container, the shape of the lid, the disc, etc., which might cause the top surface of the disc to be slightly tilted with respect to the rubbing means in the lid, are compensated for by the normal yieldable resilient bias of the foam disc against the pressure applied to it by the rubbing means in the lid. If manufacturing tolerances cause the rubbing means to be somewhat tilted or to be somewhat higher or somewhat lower than expected with reference to the indicator layer, the foam layer will still press the indicator uniformly against the rubbing means and the foam layer will deform sufficiently to compensate for these tolerances, assuring a secure engagement between the rubbing means and the indicator for optimal activation of the indicator.

The indicator may, as before, be a thin sheet of paper coated with an appropriate ink or dye, like a leuco dye, which is microencapsulated and which changes color upon exposure to air, or the microcapsules of dye might be directly coated atop the disc without a thin paper supporting layer.

The disc might be undesirably thick where it rests upon the container neck, so that the lid would not be adequately tightened down over the container. To avoid this problem and additionally to strengthen the foam layer disc, the annular peripheral marginal region of the foam disc is permanently compressed, for example during the fabrications of the discs, for example to one-third of the thickness of the disc, giving the peripheral marginal region of the disc much greater density and resultant rigidity, which strengthens the disc specifically so that its center does not collapse or bow due to the pressure applied to it by the lid and rubbing means. The bottom surface of the disc has adhesive applied to it which supports the disc at the neck of the container.

Accordingly, it is the primary object of the present invention to provide a tamper-evident indicator for a lid, which becomes visible upon rotation of the lid with respect to the container.

It is a further object of the present invention to provide an indicator which is activated by rubbing.

It is another object of the present invention to provide the indicator on the container.

It is a further object of the invention to assure secure engagement between the rubbing means in the lid and the indicator on the container.

It is yet another object of the invention to rigidify the disc holding the indicator on the container and also the rubbing means in the lid for assuring secure engagement therebetween.

It is a still further object of the invention to accommodate tolerances which arise during fabrication of the container, lid and indicator supporting disc to assure the secure engagement between the rubbing means and the indicator.

It is another object of the invention to minimize the number of separate components used in the completed disc.

The foregoing and other objects of the invention will become apparent from the following description of a preferred embodiment of the invention taken in conjunction with the accompanying drawings.

BRIEF DESCRIPTION OF THE DRAWINGS

FIG. 1 is a perspective view of a fragment of a container and a cross-sectional view of a lid for the container, and including the indicator of a tamper-evident lid arrangement according to the invention;

FIG. 2 is a cross-sectional view along the line and in the direction of arrows 2 in FIG. 1, showing the underside of the lid;

FIG. 3 is a top plan view in the direction of the arrows 3 showing the top of the indicator disc;

FIG. 4 is a side cross-sectional view of the disc of FIG. 3 along the line and in the direction of arrows 4—4 of FIG. 3;

FIG. 5 is a side view of a sheet or strip of discs according to the invention; and FIG. 6 is a side cross-sectional view of a fragment of that sheet prior to its working into discs of FIG. 5 and illustrating the process of forming the sheet of discs shown in FIG. 5.

DETAILED DESCRIPTION OF THE INVENTION

Referring now to FIG. 1, a container and lid combination 10 is shown. It includes a conventional container 12 of plastic, glass, or the like, which has a neck 14 with a flat annular top edge 16 to which is attached a disc 50 carrying an indicator and designed according to the invention. Spaced down from the upper edge 16 of the container is a collar 18, the upper surface 22 of which serves as a bottom support and abutment for the bottom 86 of the flange of the below-described lid 80. Spaced up from the collar 18 a short distance is another collar 24 used for locking the lid to the container. The collar 24 has a downwardly, outwardly inclined exterior 26 which enables the flange 92 around the bottom of the lid to slide over the collar exterior 26, and the collar 24 has a lid flange engaging, flat underside 28, which locks the flange of the lid against being subsequently lifted straight off the neck of the container until the lid has been rotated to the removal position. The collar 24 is interrupted at 32 over a short angular section to define a keyway for enabling the tab or key 94 at the flange 92 of the lid to be lifted past the keyway 32 and past the collar 24 on the neck of the container to permit lid removal once the lid has been rotated to bring the tab or key 94 to the keyway 32.

Referring to FIGS. 3 and 4, at the top 16 of the neck of the container is located the disc 50 according to the invention and having the indicator thereon. The disc closes the open top 12 of the neck 14 of the container and serves to seal the container like a conventional disc seal. An annular ring of adhesive 54 is provided beneath the bottom of and at the periphery of the disc for adhering the disc non-rotatably but removably to the top edge 16 of the neck of the container. Alternately, the entire bottom surface of the disc may be coated with an adhesive. The adhesive may be of such a type or may be packaged in microcapsules such that it adheres to the container neck upon being pressed against the neck. Once the lid has been applied to the container, the adhesive will hold the disc 50 against rotation as the lid 80 is rotated, enabling activation of the indicator.

The disc is comprised of a thin resilient layer 56 of a foam material which biases an indicator layer 58 located atop the foam layer toward rubbing means 110 in the lid, as described below, and which disc compensates for manufacturing tolerances in the lid, the neck of the container and the disc itself to assure secure engagement between the indicator on the disc and the rubbing means in the lid, by flexibly deforming when the lid is placed over the neck of the container. The foam material is an extruded, expanded polystyrene foam of a density, for example, of 7–8 pounds per cubic foot. It is 0.080" thick for a disc of a 1" outside diameter. These parameters may vary for different diameter discs or as necessary for a particular container.

Disposed above the foam layer 56 is a thin paper layer 58, the underside of which is adhered securely to the foam layer. On the top surface of the paper layer 58 is an indicator in the form of a coating of microencapsulated ink or leuco dye which darkens when it is exposed to air. The indicator may be coated over the entire surface of the paper layer 58, or may be limited to an annular region of that layer which can be viewed through the viewing means 83 in the lid, as described below. The indicator layer or coating of microencapsulated ink may be applied directly on the top of the foam material of the disc without the supporting paper layer.

The microcapsules of a color changeable ink supported on a paper layer or directly atop the foam disc are a conventional leuco dye available from Appleton Papers, Inc., of Appleton, Wis. In addition, NCR Paper SC White 190, also made by Appleton Papers, Inc., is a paper coated with such a leuco dye. The microencapsulated ink is colorless in the capsules but when it is exposed to air, it immediately oxidizes and darkens. Rubbing of the indicator occurs upon rotation of the lid. This ruptures the capsules, exposing the ink to air. The observable darkening of the indicator would enable a viewer to know that the lid had been rotated, and perhaps removed from the container.

The disc 50 has a unique construction for assuring that the indicator layer 58 will securely engage rubbing means in the lid for being activated thereby, for biasing the indicator layer toward the rubbing means regardless of manufacturing tolerances in the container, lid or disc itself and which stiffens the disc sufficiently to assure that the rubbing means will activate the indicator. As noted above, the disc 50 is formed from an expanded polystyrene foam of 0.080" thickness. The thickness is selected so that the disc will be compressible to compensate for manufacturing tolerances and so that the disc will be resilient to bias the indicator toward the lid.

To stiffen the disc against deforming and particularly bowing downward at its center as the rubbing means in the lid presses down upon the top of the disc, the disc is not of uniform height or density. Instead, an annular peripheral ring 62 is integrally defined on the disc and it is thinner in thickness and denser than the rest of the disc and is much stiffer than the rest of the disc. The ring 62 does not deform resiliently as pressure is applied to it, at least not to the extent that the central portion of the disc will deform, and because the ring 62 encircles the central portion of the disc, the ring prevents the entire disc from deforming.

A notch 63 is formed in the ring 62 and the disc 50 is indexed on the neck of the container so that the notch 63 is aligned with the keyway 32 in the flange 24. The below described key 94 on the lid projects radially inwardly and the keyway 32 and notch 63 permit the lid 80 and the key 94 to be lifted without lifting the disc.

The construction of the annular peripheral ring portion 62 of the disc is better understood when a method of forming the discs 50 is explained. Referring to FIGS. 5 and 6, an elongate sheet 64 of uniform thickness extruded, expanded polystyrene foam material 64 is applied on a supporting platen 66. The individual discs are to be taken from and formed in the sheet 64. A disc forming die 70 is provided, which includes a respective heated pressure applying ring 72 for each disc 50 to be formed. An annular knife 74 depends from beneath the ring 72 for cutting off the respective disc 50 from the rest of the sheet 64. The ring 72 surrounds an upraised cavity 76 into which the central portion of the disc 50, 56 projects when the die 70 descends. The height of the cavity 76 is tall enough that it would not contact the top of the disc 50 when the die 70 descends, so as to avoid heating or compressing the central portion of the disc 50. The ring 72 and knife 74 in the die are heated conventionally, e.g. by a heating coil (not shown). The die 70 is caused to descend by conventional means toward the platen 66. The knife 74 cuts through the foam sheet to define an individual disc 50. The heated annular ring portion 72 of the die compresses the foam at the peripheral margin of the disc 50 and heats the same as it compresses it, which sufficiently softens the foamed plastic at the peripheral margin of the disc to permanently compress the same even after the die 70 is raised off the disc 50. When the die 70 is upraised off the sheet 64, the array of discs 50 has been formed, as can be seen in FIG. 5, and each of the discs is also separated by respective knife 74 and the disc may be lifted off the platen at that time.

The disc thus formed is still incomplete in two respects. The adhesive layer 54 must be applied beneath the disc. This can be done in a separate step either prior to or subsequent to the formation of the individual discs 50 from the sheet 64. One possibility is to coat the platen 66 with an adhesive material which will transfer to the discs. Also, the adhesive could be applied by a roller, by being sprayed on, or by other known means.

The indicator layer 58 must be applied to the central portion 56 of the disc 50. That layer may be applied to the disc subsequent to its formation, or the indicator layer may be applied to the entire sheet 64 before the individual discs are formed. In the latter case the die 72 will destroy the indicator material at the annular ring 62 of the disc. But this will present no problem, as the indicator is not to be observed at the periphery of the disc. The indicator microcapsules may be sprayed directly on the surface of the disc, may even be applied by roller on the disc, or may be otherwise applied in conventional manner.

The discs 50 may be stored on the platen 66 until each individual disc is required, and it is then simply lifted or peeled from the platen.

The disc 50 is quite simple in construction, quite simple to fabricate, yet is effective in supporting an indicator to be activated by the lid and for compensating for any manufacturing tolerances in the lid, disc and container combination. The disc is constructed to avoid deforming upon pressure being applied to the disc by the lid.

For cooperating with the disc 50, the lid 80 for the container is of conventional lid construction with the rubbing means 110 added. The lid 80 is comprised of transparent thermoplastic material which is stiff, but not rigid. The transparency of the lid permits viewing of the indicator through the lid. The entire lid need not be transparent. For example, only the top 82 of the lid may be transparent. Alternatively, the lid need be transparent only over the area through which the indicator is to be viewed. For example, the viewing means through the lid might be an annular transparent strip or a short arcuate length clear area 83 above the indicator. The flat top 82 of the lid extends completely over the disc. Depending beneath the top 82 of the lid is the annular side wall 84 which extends down past the side of the neck 14 of the container. The lid side wall has a bottom side 86 which rests against the top of the positioning collar 18 on the neck of the container. The height of the lid 80 is selected so that with the lid on the container, the below described rubbing means rubs the indicator. The side wall 84 also has the internal annular profiled groove 88 which mates with the collar 26, 28 on the neck 14 for securing the lid to the container. The slightly inwardly projecting flange 92 at the bottom of the lid snaps under the bottom 28 of the collar 26 to hold the lid in place. However, this flange 92 is radially short enough that the lid could be raised off the collar 26. At one short arcuate section 94, the flange 92 is elongated inwardly to define a tab or key 94 which projects all the way under the collar 26, 28 and prevents raising of the lid off the collar. When the lid is rotated so that the key 94 is aligned with the arcuate section keyway 32 through the collar 26, then the lid 80 can be lifted off the neck of the container from the side at which the key 94 is defined, and the remainder of the flange 92 will deflect to permit the lid to be raised off over the collar 28.

The underside of the lid carries rubbing means 110. The rubbing means must have the capability of rubbing or scraping the indicator 64 on the disc. Where the indicator is encapsulated in microcapsules, the rubbing means comprises a roughened surface or abrasive material on the underside of the lid and opposed to the indicator.

The lid 80 is a single molded piece lid with an abrasive surface 110 on the underside of the top 82 of the lid that is formed during the molding process. The material of at least the top of the lid is transparent. While the entire indicator could be viewed through the lid, the roughened abrasive surface 110 will considerably diffuse the viewed image of the indicator 58 beneath the lid and may make it difficult to observe the condition of the indicator. A small size, smooth, unroughened area 83 is molded in the otherwise roughened surface and this smooth area will permit a view through the top of the lid to the indicator beneath it, without excess diffusion of the light. The placement of the abrasive surface 110 would be selected, as is the placement of the indicator material 58, to activate the indicator where it can be observed through the lid. The indicator might only be arranged in an annular ring on the disc facing the underside of the lid, and then the abrasive surface 110 may have a similar shape on the underside of the lid.

An alternate embodiment of lid, not illustrated, but shown, for example, in the above-noted application Ser. No. 549,975 of this inventor, places the abrasive means not directly on the underside of the lid, but instead on the underside of another thin resilient disc, for example, having the characteristics of the disc 50, which is supported at the underside of the lid. The height of the lid and the heights of the disc on the indicator and at the underside of the lid would be respectively so selected that the rubbing means at the underside of the lid would rub the indicator layer atop the disc on the container for activating the same.

The lid 80 is normally disposed over the container 12 at an orientation where the key 94 is not initially aligned at the keyway 32. In fact, it is preferred that the lid would have to be rotated a considerable distance before the key and keyway become aligned.

To assure sufficient rubbing of the indicator on the disc 50, the lid 80 should be rotated a considerable distance before it can be removed, e.g. over 180°. Removal of the lid 80 from the container would initially require rotation of the lid to bring the key and keyway into alignment, and this rotation would cause the rubbing means 110 to rub the indicator 58 for activating the same, which would provide a visible indication that the lid has been moved. With the lid and indicator combination described, a person viewing the indicator through the lid may observe the initially uncolored indicator and the progressive darkening of the indicator as it is rotated. A person who observes a darkened condition of the indicator and who did not previously observe an undarkened condition, can infer that the lid had previously been rotated in a direction to permit its removal and perhaps had been removed. Therefore, by observing the lid itself, perhaps at the point of sale, perhaps after the point of sale, but in any event before use of the contents of the container, a person will have an indication from which he may infer whether steps had been taken to remove the lid or the lid was in fact removed.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. An indicator arrangement for a tamper-evident container lid, comprising:

a disc for being applied to the open neck of a container; the disc being comprised of a layer of resilient foam material which is adapted to deform when pressure is applied to it and which resiliently self biases to restore itself from being deformed; the disc having a bottom for being applied on the neck of a container; the disc having a top; an indicator on the top of the disc and adapted for providing a visible indication when the indicator is rubbed;

a lid for being placed over the neck of the container and over the top of the disc; the lid having an underside above and opposed to the indicator; and indicator rubbing means at the lid underside for being rubbed over the indicator as the lid is rotated around the neck of the container and with respect to the disc for activating the indicator on the disc; and the foam material being resilient for urging the indicator toward the rubbing means at the underside of the lid.

2. The indicator arrangement of claim 1, wherein the disc includes an annular peripheral marginal part and the foam material of the disc is permanently compressed to a greater density in the annular peripheral marginal part of the disc, as compared with the density of the foam material of the rest of the disc.

3. The indicator arrangement of claim 1, wherein the disc has a height and density related to the width of the opening in the neck of the container such that the disc resists deforming away from the rubbing means toward the center of the disc.

4. The indicator arrangement of claim 3, wherein the disc includes an annular peripheral marginal part and the foam material of the disc is permanently compressed to a greater density in the annular peripheral marginal part of the disc, as compared with the density of the foam material of the rest of the disc.

5. The indicator arrangement of claim 4, wherein the disc is formed of extruded, expanded polystyrene foam.

6. The indicator arrangement of claim 5, wherein the disc has a thickness of about 0.080" and a foam density of about 7–8 lbs. per cubic foot.

7. The indicator arrangement of claim 4, wherein the indicator is applied directly to the top of the disc.

8. The indicator arrangement of claim 4, wherein the indicator comprises a carrier sheet applied directly to the top of the disc on which an activatable indicator is applied.

9. The indicator arrangement of claim 4, wherein the bottom of the disc is the bottom of the layer of foam material and the top of the disc is the top of the layer of foam material.

10. The indicator arrangement of claim 2, further comprising adhesive on the bottom of the disc for adhering the disc to the neck of a container.

11. In combination, the indicator arrangement of claim 1 and a container; the container having an open neck into the container, and the neck having an open top; the bottom of the disc being applied to the open top of the neck and being supported there for closing the open top; means preventing rotation of the disc with respect to the open top of the container as the lid is rotated with respect to the disc and the container.

12. The indicator arrangement of claim 2, further comprising viewing means in the lid for enabling viewing of the indicator through the lid, both before and after activation of the indicator.

13. The indicator arrangement of claim 2, wherein the rubbing means comprises and abrasive material at the underside of the lid.

14. The indicator arrangement of claim 2, wherein the indicator comprises a layer of rupturable capsules on the top of the disc, and the capsules contain material which gives the indication when the capsules are ruptured; the rubbing means being for rupturing the capsules as the rubbing means rubs over the capsules as the lid is rotated with respect to the disc.

15. The indicator arrangement of claim 14, wherein the rubbing means comprises an abrasive material at the underside of the lid.

16. The indicator arrangement of claim 15, wherein the viewing means comprises the lid being sufficiently transparent to permit viewing of the indicator through the lid and past the rubbing means.

17. The indicator arrangement of claim 14, wherein the rubbing means is integrated into the material of the lid at the underside of the lid, and the viewing means comprises the lid being transparent enough to view the indicator through the lid.

18. The indicator arrangement of claim 2, wherein the rubbing means extends over the entire area of the indicator which may be viewed through the viewing means, and the viewing means comprises an interruption in the rubbing means for permitting viewing past the rubbing means to the indicator on the top of the disc.

* * * * *